United States Patent [19]

McPherson

[11] Patent Number: 4,739,712

[45] Date of Patent: Apr. 26, 1988

[54] AIR CURTAIN APPARATUS FOR PIT BURNING

[75] Inventor: Donald L. McPherson, Tifton, Ga.

[73] Assignee: McPherson Systems, Inc., Tifton, Ga.

[21] Appl. No.: 39,583

[22] Filed: Apr. 16, 1987

[51] Int. Cl.[4] ..... F23J 15/00

[52] U.S. Cl. ..... 110/203; 98/36; 110/119; 110/297

[58] Field of Search ..... 110/203, 297, 301, 309, 110/233, 235, 239, 315, 316, 182.5, 119, 147; 98/36; 126/343.5 R, 343.5 A, 271.1, 271.2 R, 271.2 A, 271.2 C, 271.3; 239/350, 397, 597, 600

[56] References Cited

U.S. PATENT DOCUMENTS

| | | | |
|---|---|---|---|
| 3,483,832 | 12/1969 | Bolli et al. | 110/203 X |
| 3,704,676 | 12/1972 | Davies et al. | 110/203 X |
| 3,773,000 | 11/1973 | Applegate | 110/203 |
| 3,899,984 | 8/1975 | Keyes et al. | 110/203 |
| 4,241,671 | 12/1980 | Joyner et al. | 110/235 X |
| 4,480,558 | 11/1984 | Russell | 110/297 |

*Primary Examiner*—Steven E. Warner
*Attorney, Agent, or Firm*—Rodgers & Rodgers

[57] ABSTRACT

Apparatus for supplying an air curtain into a pit to facilitate combustion of material disposed within the pit includes an air supply tube mounted on wheels and having an inlet end and an outlet end, a nozzle structure disjointably mounted on the air supply tube at the outlet end thereof and in transverse relation thereto, a motor driven fan for supplying air through the air supply tube and the nozzle and into the pit, the junction between the air supply tube and the nozzle being readily disjointable to accommodate mounting of the nozzle atop the air supply tube for transport along a roadway.

8 Claims, 2 Drawing Sheets

AIR CURTAIN APPARATUS FOR PIT BURNING

TECHNICAL FIELD

This invention relates to apparatus for supplying a curtain of air into a pit of generally rectangular horizontal cross sectional configuration and which contains material to be burned such as tree limbs, stumps and other debris.

BACKGROUND ART

U.S. Pat. No. 3,773,000 issued Nov. 20, 1973 discloses an air curtain apparatus in which a wheel mounted air supply tube is hingedly connected to a nozzle structure disposed in transverse relation to the air supply tube at the outlet end of the air supply tube. The hinged connection is designed to allow the nozzle portion of the apparatus to swing alongside of the air inlet tube in order to facilitate the transport of the apparatus from one job to another. One objection to this type of apparatus is that it is of considerable width due to the side by side orientation of the air supply tube and the nozzle. Also, the hinged connection is cumbersome and time consuming to manipulate properly.

Another known apparatus for supplying an air curtain to a pit for burning material within the pit is disposed alongside the pit and includes an elongated nozzle tube having air outlets along the length and which is supplied with air from one end thereof through a coaxial air supply tube. With such apparatus it is difficult to insure a uniform volume of air throughout the entire length of the pit due to changes in the velocity of air flow along the length of the conduit due to friction between the air and the inner surfaces of the nozzle structure.

Still another known arrangement for supplying a curtain of air to a pit containing material to be burned includes an air inlet tube connected at its air outlet end with a transversely disposed nozzle structure, the interconnection between these two elements being in the form of complementary flanges which are bolted together. Obviously such an arrangement is difficult to manipulate since the bolt holes in the cooperating flanges must be aligned and because uneven conditions of the ground near the pit further enhance the difficulty of making the bolted connection between the cooperating flanges.

SUMMARY

According to this invention in one form, an air supply tube is of generally rectangular configuration and a generally horizontal support member is disposed in transverse relation across the upper part of the outlet end of the air supply tube, while a complementary structure formed on the upper part of an associated nozzle overlies and partially envelops the support member and disjointable clamping means is arranged to secure the lower portions of the nozzle with lower portions of the outlet end of the air supply tube, suitable means being provided for supplying atmospheric air into the inlet end of the air supply tube through the nozzle and into the pit containing material to be burned. The inner connection between the nozzle and the outlet end of the air supply tube is readily disjointable so that the transverse nozzle may be hoisted by convenient means to a position atop the air supply tube where the nozzle is supported by upstanding brackets forming a part of the air supply tube. The fast, easy, efficient and convenient procedure for connecting and disconnecting the nozzle and the air supply tube constitutes a principal feature of this invention.

BEST MODE OF CARRYING OUT THE INVENTION

Figure 1:
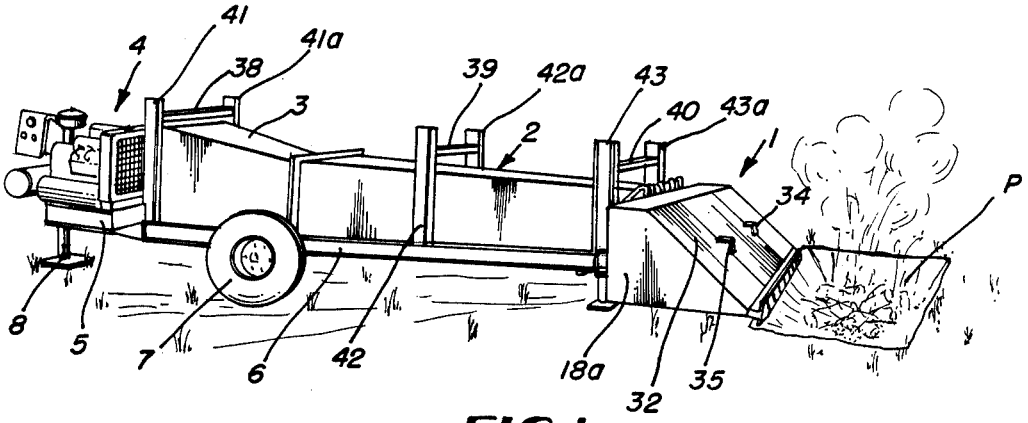
FIG. 1 is an overall perspective view of apparatus for supplying an air curtain into a pit and which is formed according to this invention.
Figure 2:
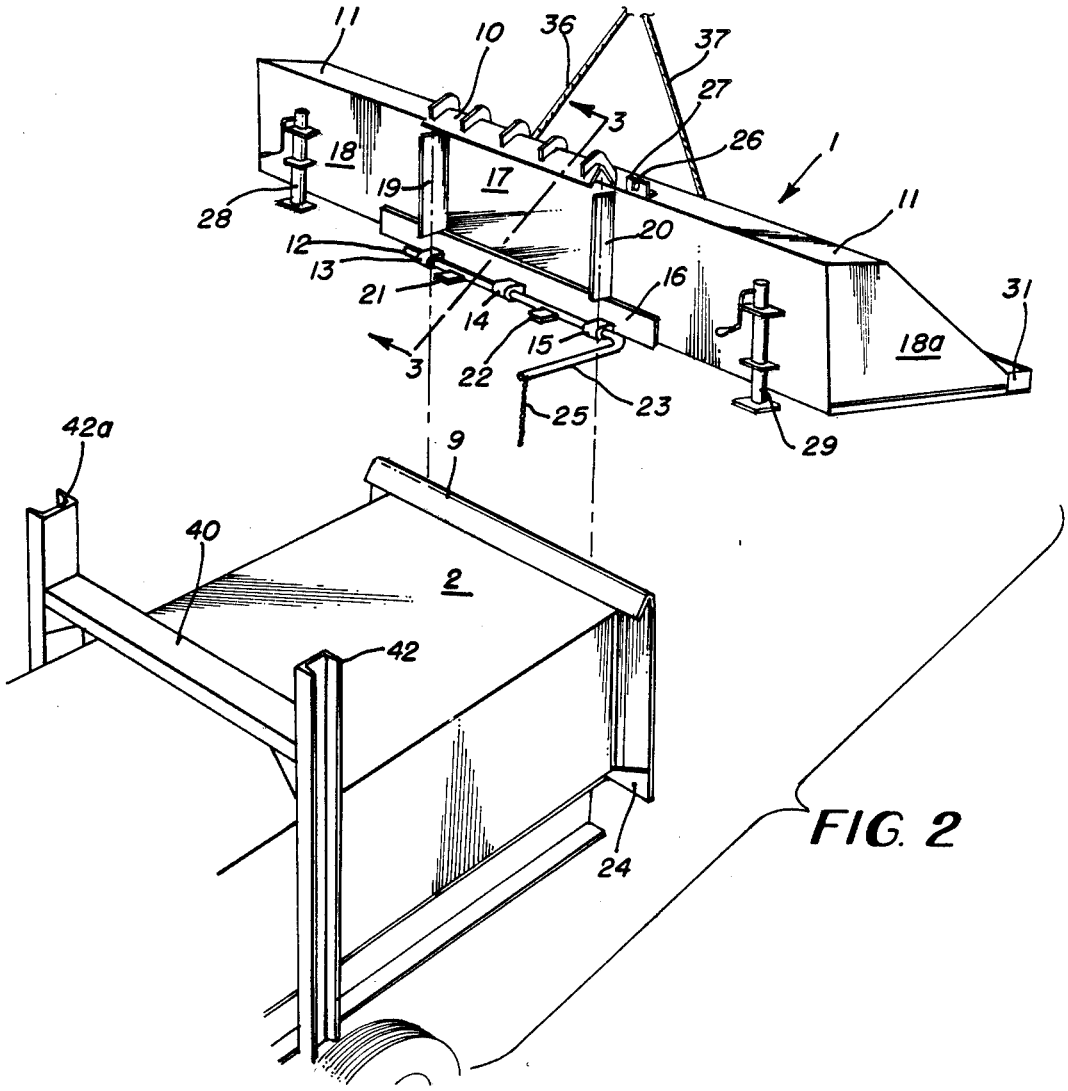
FIG. 2 is a view of a portion of FIG. 1 and which shows the outlet end of an air supply tube in spaced relation from the nozzle.
Figure 3:
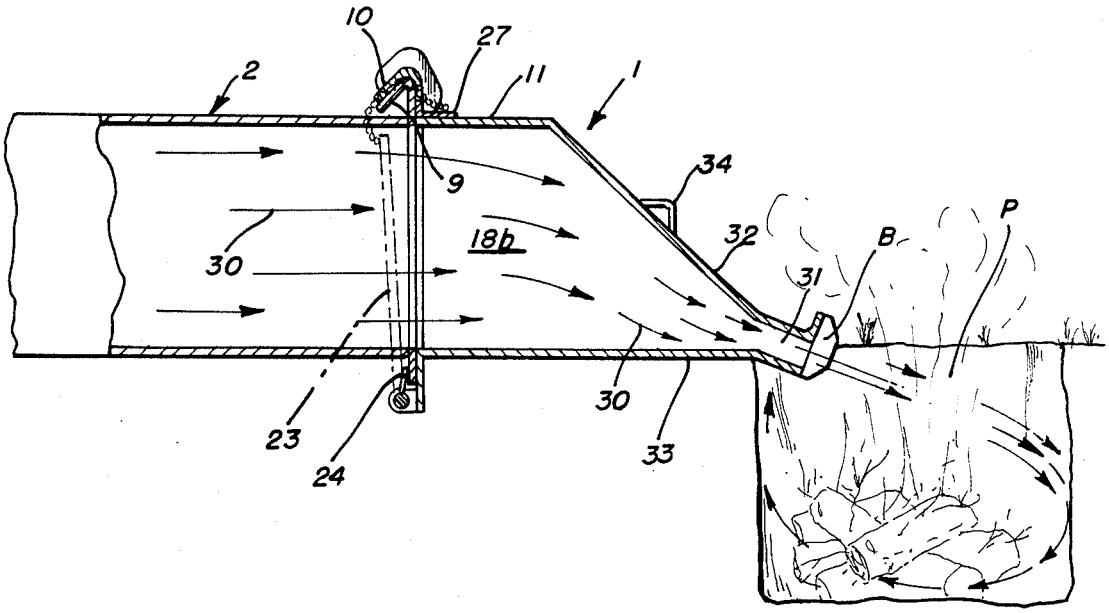
FIG. 3 is a cross sectional view taken generally along the line designated 3—3 in FIG. 2 and which in addition shows the cooperating adjacent end of the associated air supply tube.

In FIG. 1, a pit is designated at P and contains debris such as trees, limbs, stumps and the like which are to be burned. The numeral 1 generally designates a nozzle disjointably connected with an air supply tube generally designated by the numeral 2. Air is supplied to the inlet end 3 of the air supply tube 2 by means of a fan not shown and which is rotated by a conventional gasoline or diesel engine generally designated at 4 which is mounted on frame element 5 which forms an extension of the main frame structure 6 which is mounted on and supported by a pair of wheels 7 only one of which is observable in FIG. 1 together with a pedestal 8 supported by the ground and engageable with the part 5 of the frame 6. At the outlet end of air supply tube 2, a support member 9 is secured atop the air supply conduit 2 as is best shown in FIGS. 2 and 3. The support member 9 is generally configured in cross section as an inverted V which cooperates with a complementary structure 10 fixedly mounted atop the horizontal element 11 forming a portion of nozzle 1.

When the nozzle 1 is mounted in cooperative relation with the air supply tube 2, the element 10 overlies the element 9 as best shown in FIG. 3.

For securing the lower portion of the nozzle 1 to the lower portion of the air supply tube 2, a locking bar 12 is rotatably mounted within journals 13, 14, and 15 which are secured to transverse plate 16 forming a part of the nozzle 1 immediately below the aperture 17 formed in back plate 18 of nozzle 1 and disposed between the side baffle plates 19 and 20 which are physically secured to the back plate 18 of the nozzle 1 so as to facilitate a secure pneumatic connection between the nozzle 1 and the air supply tube 2. The ends of nozzle 1 are closed by plates **18*a* and 18*b*. Locking tabs 21 and 22 are rigidly affixed to locking bar 12 and rotation of locking bar 12 is by manually operable handle crank 23 integrally formed with one end of locking bar 12. Thus rotation of locking bar 12 in a generally clockwise direction as viewed in FIGS. 2 and 3 causes the locking tabs 21 and 22 to swing into locking engagement with a transverse bar 24 securely affixed and projecting downwardly from a lower portion of the air supply tube 2 at the outlet end thereof. Locking handle 23 is secured in locking position by means of locking chain 25 which is disposed within a notch 26 formed in angle iron 27 welded to the cross piece 11 of nozzle 1**.

For the purpose of affording stability to the apparatus, an adjustable jack 28 is secured to one end of the plate 18 of nozzle 1 while a similar adjustable jack 29 is mounted on the opposite end of the back plate 18. Vertical adjustment of the vertical elements of these jacks affords stable contact with the ground which of course may be uneven. In FIG. 3, the handle 23 is shown in phantom lines because this structure would not be observable in the cross sectional view taken along the line 3—3 as designated in FIG. 2.

The flow of air is designated by the arrows such as 30 as shown in FIG. 3 and proceeds from left to right and out of the exhaust slot 31 formed between the lower portion of plate 32 and bottom plate 33. Vertical bars B are spaced apart from each other and secure the adjacent parts of plates 32 and 33.

From FIGS. 1 and 3 it is apparent that the nozzle 31 is disposed but a short distance over and beyond the adjacent edge of the pit P so as to avoid undue heating of the outlet part of nozzle 1.

Figure 4:
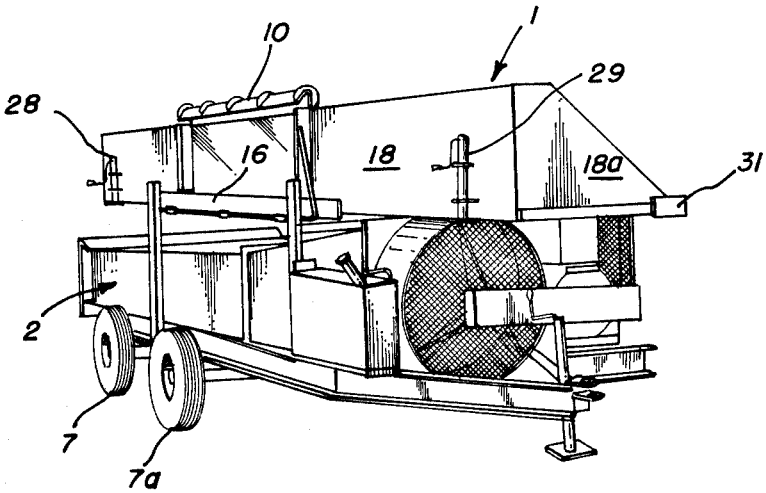
FIG. 4 is a perspective view showing the nozzle structure mounted atop the air supply tube and in condition for transmission along a roadway, an additional pair of wheels being shown for stability.

In order to disconnect the nozzle 1 from the air supply tube 2, it is only necessary to lift the chain 25 out of the notch 26 formed in angle iron 27 and to rotate the handle 23 in a counterclockwise direction as viewed in FIGS. 2 and 3. The nozzle 1 may then be lifted away from air supply tube 2. As shown in FIG. 2, lift hooks 34 and 35 are rigidly affixed to the plate 32 of nozzle 1 and serve as points of interconnection with hoisting cables such as are indicated in FIG. 2 at 36 and 37. As is apparent in FIG. 1, horizontal bars 38, 39 and 40 are interconnected at their ends with vertical posts such as 41, 42 and 43 and their counterparts 41a, 42a, and 43a. Thus the nozzle 1 is lifted by suitable lifting apparatus and the cables 36 and 37 and swung into position atop the air supply tube 2 to a position of rest on the bars 38, 39 and 40 as represented in FIG. 4. For stability during transit over roadways, an additional pair of wheels 7*a* may be used if desired.

Obviously with the nozzle 1 disposed atop the air supply conduit 2, the width of the structure is considerably reduced from a horizontal disposition of these elements and thus facilitates roadway travel. The quick and easy disjointability of the nozzle 1 from the air supply tube 2 further contributes substantially to the practical applicability of this apparatus and greatly facilitates the transfer of the apparatus from one job site to another.

I claim:

1. Apparatus for supplying an air curtain into a pit of generally rectangular horizontal cross sectional configuration to facilitate combustion of material disposed within the pit, said apparatus comprising an air supply tube of generally rectangular cross sectional configuration and having an inlet end and an outlet end, a generally horizontal support member which in vertical cross section corresponds approximately to an inverted V and which is secured atop the outlet end of said air supply tube in transverse relation thereto, a nozzle structure disjointably mounted on said outlet end of said air supply tube in connection therewith and in transverse relation thereto and having support structure secured to its upper part and arranged to overlie and partially to envelope said support member, disjointable locking means including a locking bar rotatably mounted on a lower part of said nozzle and at least one locking tab thereon for engaging and disengaging a part of said air supply tube and operable to secure lower portions of said air supply tube and said nozzle together and means for supplying air through said air supply tube and through said nozzle and into said pit.

2. Apparatus according to claim 1 wherein said support structure is at least in part of complementary cross sectional configuration to said support member.

3. Apparatus according to claim 1 wherein said air supply tube includes wheels for roadway portability and support brackets projecting upwardly for engaging and supporting said nozzle when disconnected from said outlet end of said air supply tube and disposed atop said air supply tube.

4. Apparatus according to claim 1 wherein said nozzle is of converging cross sectional configuration in the direction of its outlet edge.

5. Apparatus according to claim 1 wherein lifting brackets are secured atop said nozzle for engagement by lifting apparatus arranged to hoist said nozzle into and out of its service position of connection to said air supply tube and into and out of its portable position atop said air supply tube.

6. Apparatus according to claim 1 where an adjustable jack is secured to said nozzle adjacent each end thereof and engageable with the ground to impart stability to the apparatus.

7. Apparatus according to claim 1 wherein said locking bar includes a manually operable operating handle.

8. Apparatus according to claim 7 wherein disjointable fastening means is arranged to secure said operating handle in its locking position.

* * * * *